US005511834A

United States Patent [19]

Willems

[11] Patent Number: 5,511,834

[45] Date of Patent: Apr. 30, 1996

[54] AUTOMATICALLY POSITIONED LATCH ASSEMBLY

[75] Inventor: Roger P. Willems, Penn, England

[73] Assignee: Penn Fabrication (U.S.A.) Inc., Moorpark, Calif.

[21] Appl. No.: 223,581

[22] Filed: Apr. 6, 1994

[51] Int. Cl.[6] ..... F05C 3/04

[52] U.S. Cl. ..... 292/203; 292/113

[58] Field of Search ..... 292/113, 128, 292/203, 241, 256.69, DIG. 41, DIG. 49

[56] References Cited

U.S. PATENT DOCUMENTS

| | | | |
|---|---|---|---|
| 3,051,520 | 8/1962 | Poe | 292/DIG. 49 X |
| 3,516,125 | 6/1970 | Schlueter | 292/DIG. 49 X |
| 3,519,298 | 7/1970 | Gley et al. | 292/113 |
| 3,602,723 | 8/1971 | Swanson | 292/113 |
| 3,670,371 | 6/1972 | Swanson | 292/DIG. 49 X |
| 3,998,481 | 12/1976 | Anthone | 292/DIG. 49 X |
| 4,522,436 | 6/1985 | Hoen et al. | 292/113 |
| 4,758,031 | 7/1988 | Wolfe | 292/113 X |

*Primary Examiner*—Steven N. Myers
*Assistant Examiner*—Monica E. Millner
*Attorney, Agent, or Firm*—Freilich Hornbaker & Rosen

[57] ABSTRACT

A latch assembly (90) is disclosed having structure for controlling (76) and restricting (70) the rotation of a bolt (48) carrying arm (36). The structure facilitates securement together of first and second members, e.g., an equipment case lid (22) and body (24), by preventing inadvertent abutment between the bolt and a latch striker plate (32). The structure also reduces the hazard of an uncontrolled arm.

1 Claim, 7 Drawing Sheets

AUTOMATICALLY POSITIONED LATCH ASSEMBLY

FIELD OF THE INVENTION

The present invention relates generally to latches and more particularly to latches having engagable bolt and strike members.

BACKGROUND OF THE INVENTION

The latch art is replete with apparatus for securing first and second members together, e.g., a container lid and body. Uncontrolled structure in opposing latch portions can complicate latch engagement by preventing engagable positioning of the members, i.e., the uncontrolled structure abuts other lock structure or one of the members as positioning of the members is attempted. Such uncontrolled structure can also protrude from the members to present a hazard to adjacent equipment and/or personnel.

SUMMARY OF THE INVENTION

The present invention is directed to a latch assembly incorporating structure to control and restrict the rotation of a bolt-carrying arm. The arm is rotatably mounted to a first member to facilitate rotation thereon to an engagable alignment with a striker plate mounted on a second member. The bolt is then moved along the arm to engage the striker plate and secure the first and second members together.

In accordance with a feature of the invention, a spring is disposed to yieldingly urge the arm to a first spaced relationship with the first member. This spaced relationship allows the bolt to clear the striker plate when the first and second members are positioned for securement thereto-gether. The bolt-carrying arm may then be rotated against the urging of the spring to the engagable alignment. Without this rotational control feature, the bolt and striker plate may abut and prevent engagable positioning of the first and second members.

In accordance with a second feature of the invention, an abutment member is disposed to prevent the arm from rotating past a second spaced relationship with the first member. This spaced relationship prevents rotation of the arm to a position where it constitutes a hazard to adjacent equipment and/or personnel. The first and second spaced relationships may be substantially the same.

In a preferred embodiment, the arm and first member are yieldingly connected by a spring which urges the bolt and striker plate together when they are engaged. In another preferred embodiment, the arm includes a cam mechanism for converting rotational force applied to a rotatable key to translational force on the bolt. When a user rotates the key, the bolt is moved along the arm to engage the striker plate.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
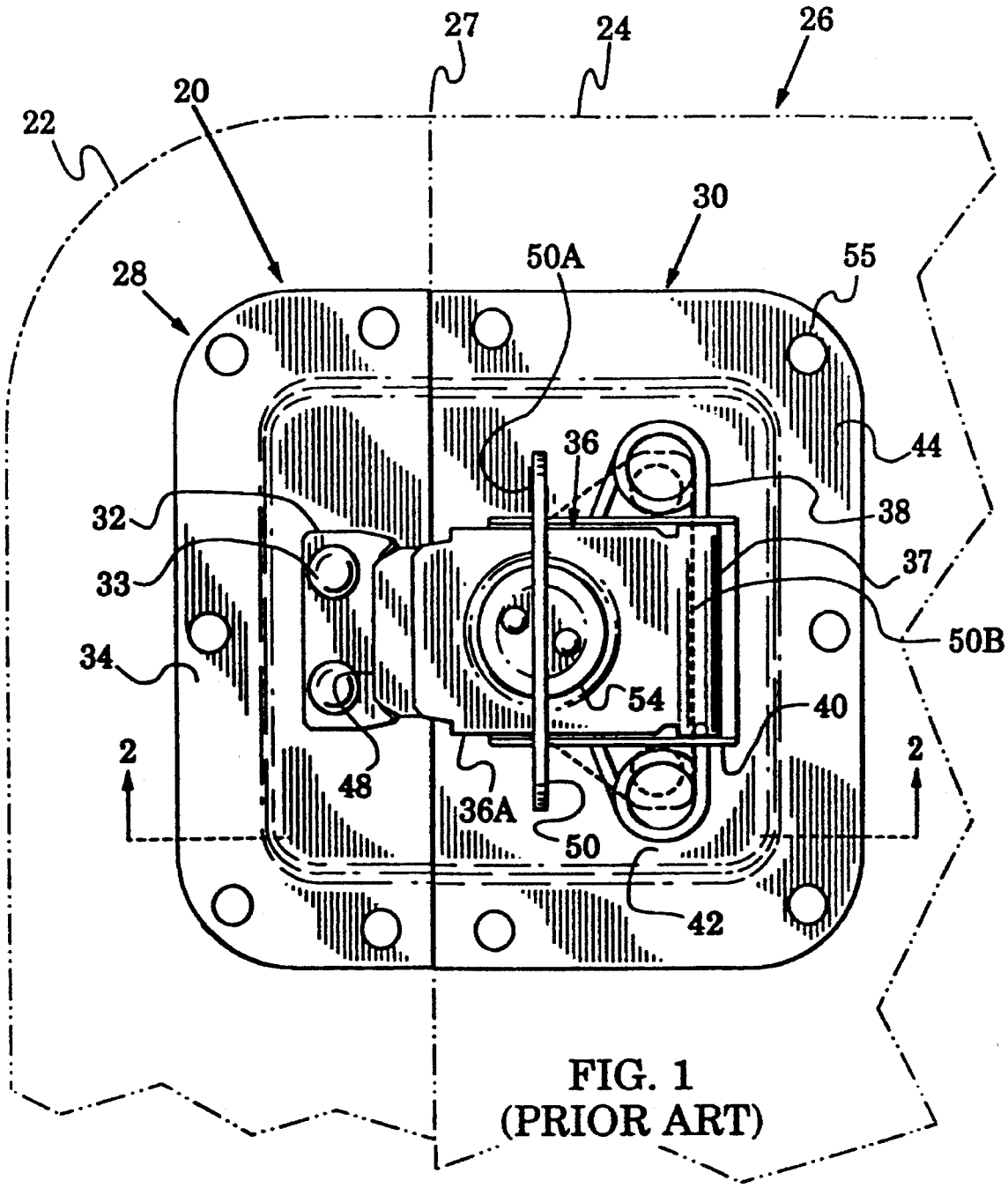
FIG. 1 (PRIOR ART)
FIG. 1 is a plan view of a prior art latch assembly installed on an equipment case lid and body for securement thereto-gether.
Figure 2:
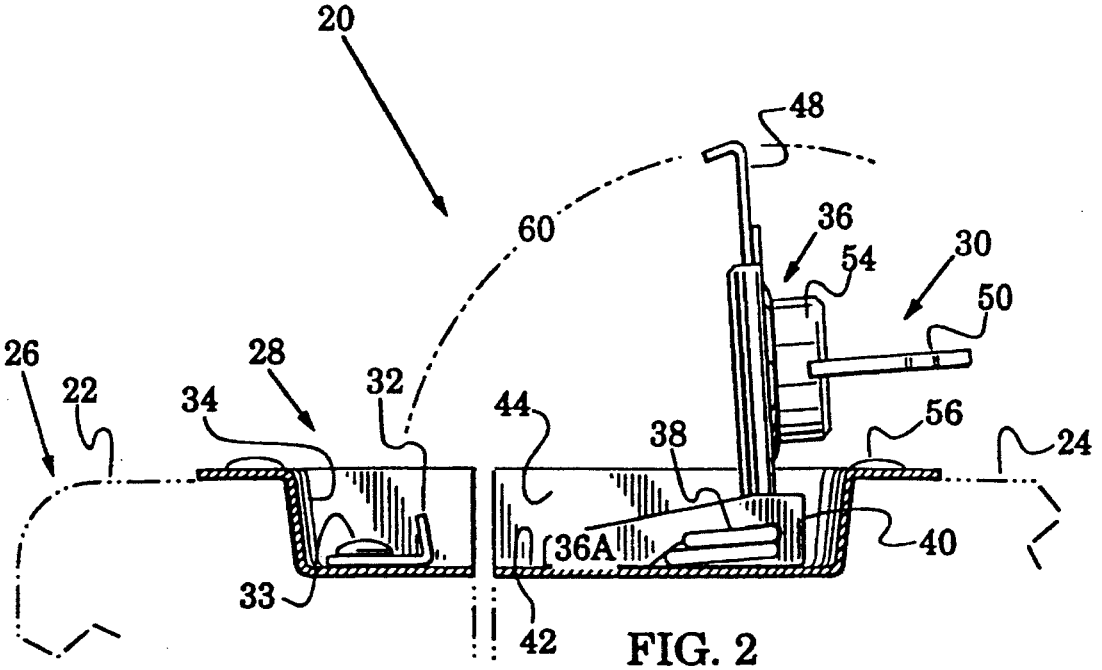
FIG. 2 (PRIOR ART)
FIG. 2 is a view along the plane 2—2 of FIG. 1 showing the unrestrained travel of an arm assembly when the latch of FIG. 1 is unlocked.

An exemplary prior art latch 20 is shown in the plan and side elevation views respectively of FIGS. 1 and 2. The latch 20 is particularly suited for securing portions of large equipment cases, e.g., the lid 22 and body 24 of case 26. When used for this purpose a plurality of latches 20 are typically spaced about the parting line 27 between the lid 22 and body 24. The latch 20 includes a striker plate assembly 28 and a bolt assembly 30 mounted respectively on the lid 24 and body 26. The striker plate assembly 28 includes a strike member in the form of a striker plate 32 mounted with fasteners, e.g., rivets 33, in a recessed half cup 34. The bolt assembly 26 includes an arm assembly 36 rotatably carried at a pivot end 37 thereof by a pair of springs 38 mounted within a support in the form of a bracket 40. The bracket 40 is secured to the floor 42 of a second half cup 44.

The arm assembly 36 includes a bolt 48, a key 50 and a cylinder 54. The bolt 48 slidably extends from one end of the arm assembly 36 to engage the striker plate 32. The extension of the bolt 48 is controlled by rotation of the key 50 which is pivotably carried by the cylinder 54 which, in turn, is rotatably mounted in the arm assembly. FIG. 1 illustrates the latch 20 with the arm assembly 36 in a locked position where the bolt 48 lockingly engages the striker plate 32. The key 50 is shown rotated to a terminal position 50A, i.e., a position in which the bolt 48 and striker plate 32 are fully engaged.

From this terminal position, the key 50 can be rotated down to the stowed position 50B shown in broken lines in FIG. 1. In this stowed position, the key 50 is substantially enclosed within the half cup 44 to protect it from accidental engagement with other equipment and/or personnel. When the lid 22 is secured to the body 24.

The half cups 34 and 44 are configured to jointly form a full cup or recess when the lid 22 and body 24 are joined. This recess substantially receives and protects the latch apparatus. The half cups 34 and 44 each define holes 55 which may receive fasteners, e.g., the rivets 56, for attachment to the case 26.

In FIG. 2, the key 50 (and attached cylinder 54) has been rotated 180 degrees from the position of FIG. 1 to a second position in which the bolt 48 is substantially fully extended. The bolt 48 is now removed from engagement with the striker plate 32 and the lid 22 may be removed from the body 24 as indicated by the spacing therebetween. Unfortunately, the arm assembly 36 is now free to rotate outward from the body 24 as indicated by the broken line arc 60. As the arm assembly 36 freely rotates along the arc 60, it projects from the body 24 which places it in position to strike other equipment with consequent damage to itself and the other equipment. In these positions it also forms a considerable hazard to personnel working adjacent the equipment case.

Figure 3:
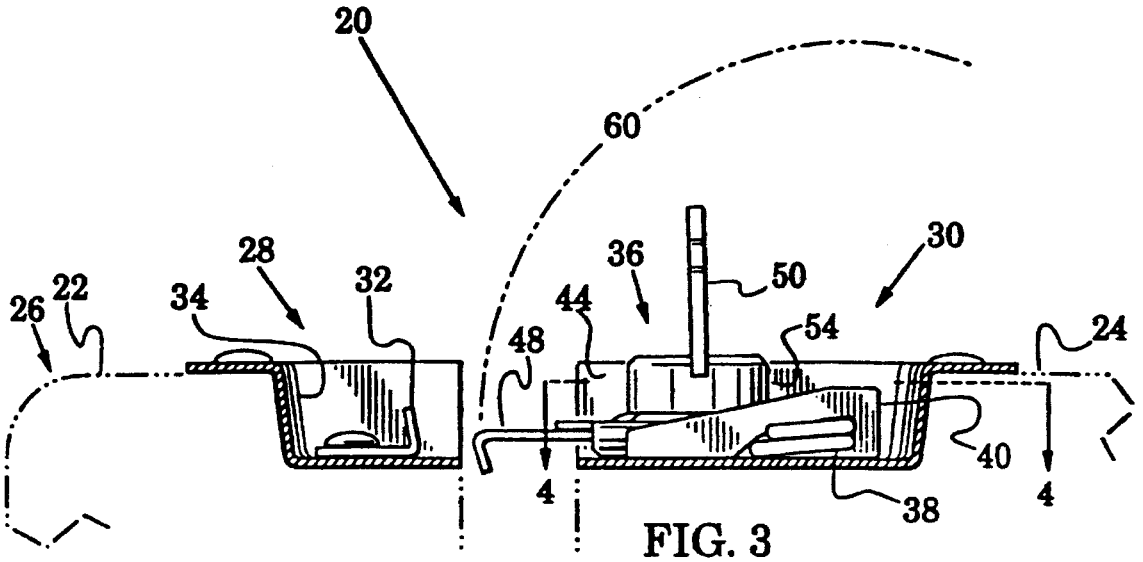
FIG. 3 (PRIOR ART)
FIG. 3 is a view similar to FIG. 2 showing further unrestrained travel of the arm assembly when the latch of FIG. 1 is unlocked.

Another consequence of the free rotation of the arm assembly 36 is that it complicates assembly of the equipment case lid 22 and body 24. This is apparent from FIG. 3 which is a view similar to FIG. 2. In FIG. 3, the body 24 is oriented such that gravity is causing the arm assembly 36 to freely swing downward along the arc 60 until it abuts the floor 42 of the cup 44. In this position of the arm assembly, the bolt 48 is directed into the side of the striker plate 32 which inhibits engagement of the lid 22 and body 24. Thus, it is required that an assembler must lift and hold the arm assembly 36 to clear the striker plate 32 as the lid 22 and body 24 are moved together to join along the parting line 37. It may be appreciated that when several latches are involved, as with large equipment cases, the time and energy required to properly position and hold several arm assemblies, often against the dictates of gravity, may be considerable.

Therefore, in accordance with the present invention, structure is introduced to restrict and control the rotation of the arm assembly 36. A preferred embodiment of this structure may be best understood from FIG. 4 which is a view along the plane 4—4 of FIG. 3 and from FIG. 5 which is a view along the plane 5—5 of FIG. 4. In these figures, the arm assembly 36 is shown only in broken lines for clarity of illustration.

In the prior art structure of these figures, the fixed end 58 of each coil spring 38 is received into a slot 62 in the bracket 40 where it is firmly held between the bracket 40 and the floor 42 of the half cup 44. The arm assembly 36 is rotatably received over the free ends 64 of each of the coil springs 38. The latch is dimensioned so that when the bolt 48 is fully engaged with the striker plate 32, as in FIG. 1, the spring free ends 64 are yieldingly pulled towards the striker plate which causes the springs 38 to exert a restoring force on the pivot end 37 of the arm assembly 36. This restoring force on the bolt 48 is in a direction that maintains engagement between it and the striker plate 32 and enhances closure between the lid 22 and body 24. Movement of the spring free ends 64 is facilitated by slots 66 in the bracket sides 72.

The preferred embodiment of the rotation restriction and control structure includes a pair of tabs 70, each extending laterally inward from a different side 72 of the bracket 40. The tabs 70 extend laterally over the arm assembly 36 where they are in position to abut it and restrict its rotation away from the floor 42 of the cup 44. The tabs 70 may be formed integrally with the bracket 40.

Control of the arm assembly 36 rotation is achieved with a resilient element in the form of a leaf spring 76 attached at a fixed end 78 to the bracket 40. The free end 80 of the spring is directed upward away from the bracket 40 to a position seen in FIG. 5 where it abuts the lower surface of the arm assembly 36. The spring 76 thus controls the arm assembly 36 by yieldingly urging it upward away from the floor 42. The spring 76 is attached with one of three rivets 82 which also serve to secure the bracket 40 to the cup 44.

Thus the spring 76 urges the arm assembly 36 upward to a ready position in which it clears and is vertically spaced from the striker plate (32 in FIG. 3). The spring 76 may be configured so that in the ready position the arm assembly 36 abuts the tabs 70 or, alternatively, the arm assembly 36 is spaced slightly from the tabs 70. In this latter configuration, the arm assembly 36 is narrowly restrained between a first position dictated by the urging of the spring 76 and a second position where it abuts the tabs 70.

Figure 5:
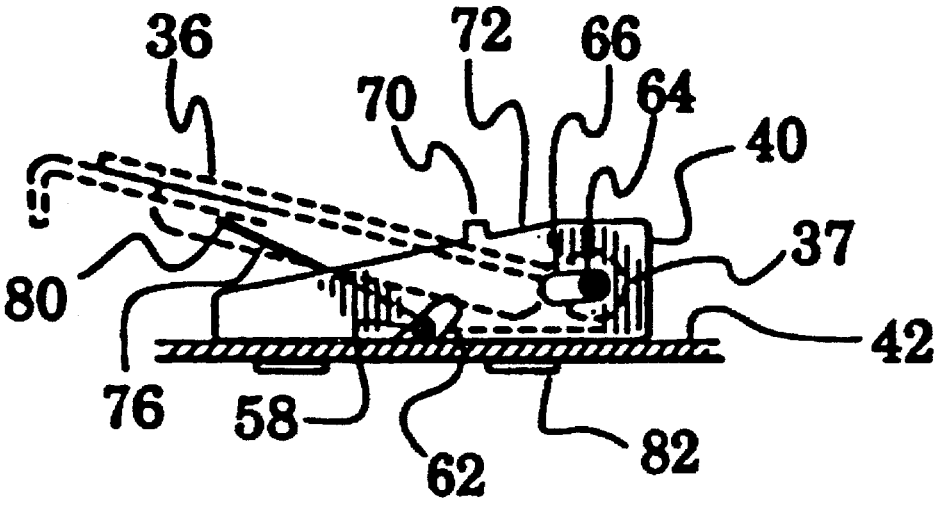
FIG. 5 is a view along the plane 5—5 of FIG. 4.
Figure 6A:
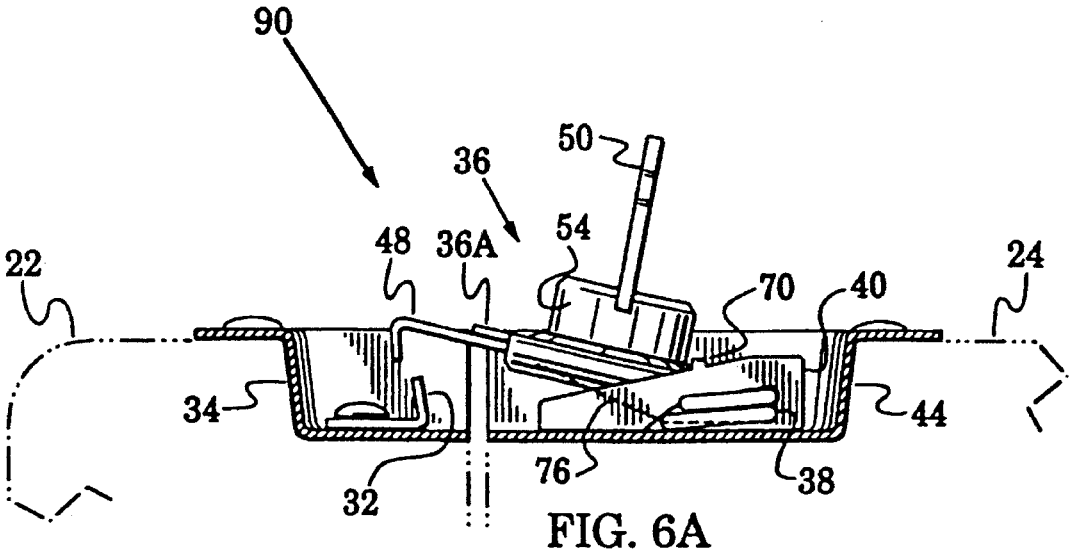
FIG. 6A is a top plan view of a preferred latch embodiment, in accordance with the present invention, in a ready position.
Figure 6B:
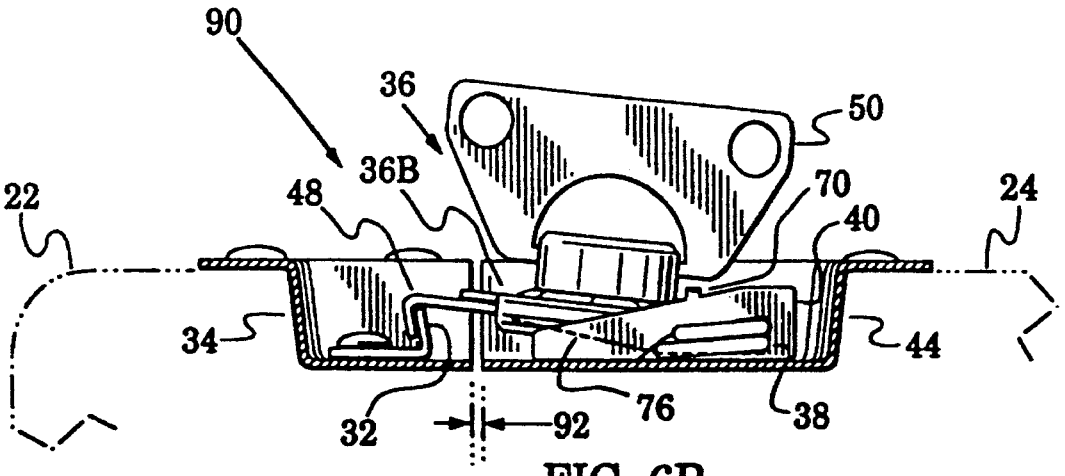
FIG. 6B is view similar to FIG. 6A showing another position of the latch of FIG. 6A.
Figure 6C:
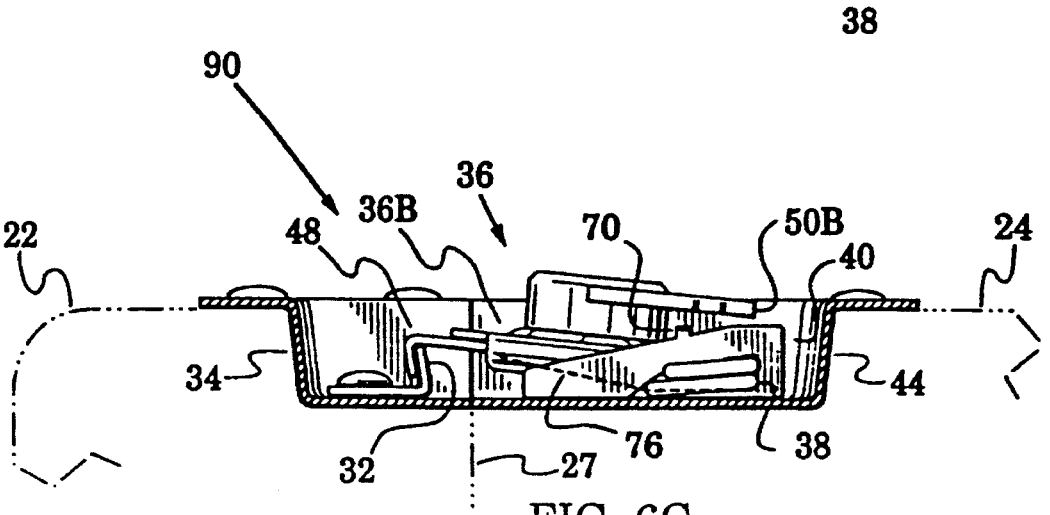
FIG. 6C is view similar to FIG. 6A showing a locked position of the latch of FIG. 6A.

Operation of the rotational restriction and control provided by the tabs 70 and spring 76, is illustrated in FIGS. 6A, 6B and 6C which are views similar to FIGS. 2 and 3. These figures show a preferred latch embodiment 90 which incorporates the tabs 70 and leaf spring 76 introduced in FIGS. 4, 5.

In FIG. 6A, the equipment case lid 22 and body 24 are spaced thereapart but in position to be joined together. The arm assembly 36 is stowed in a ready position 36A where the bolt 48 is spaced from the striker plate 32. This ready position is defined by the control function of the leaf spring 76 and the restricting function of the tabs 70, i.e., the arm assembly 36 is urged away from the cup floor 42 by the spring 76 until it either abuts the tabs 70 or is slightly spaced therefrom but where further rotation would be restricted by the tabs.

In FIG. 6B, the arm assembly 36 has been rotated downward, by a user of the apparatus, against the yielding upward urging of the spring 76. The user has also begun rotation of the key 50 and cylinder 54 which has reduced the extension of the bolt 48 from the arm assembly. The combination of these movements has caused the bolt to become engaged with the striker plate 32. This has reduced the spacing 92 between the lid 22 and body 24. Further rotation of the key 50 by a user causes further reduction of the extension of the bolt 48 until the spacing 92 is eliminated as shown in FIG. 6C where the body 24 and lid 22 now meet along the parting line 27. The arm assembly 36 is now in a lock position 36B. As described relative to FIGS. 4, 5, the free ends (64 in FIG. 4) of the coil springs 38 now urge the bolt 48 against the striker plate 32 so as to maintain contact therebetween. The key 50 may be rotated downwards to a stow position 50B as shown in FIG. 6C to minimize contact with objects and/or personnel.

Figure 7:
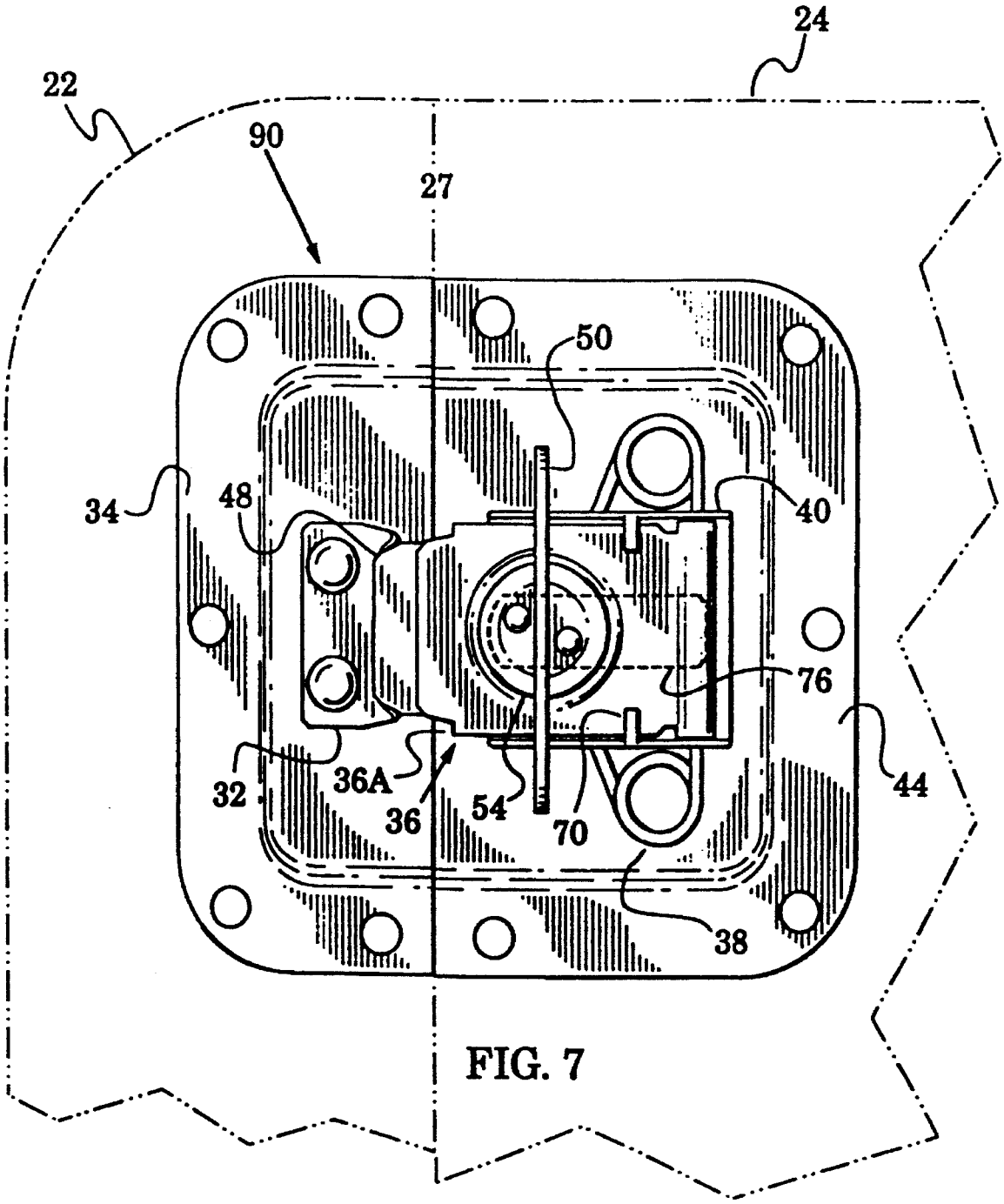
FIG. 7 is a top plan view of the latch of FIG. 6.

When a user unlocks the latch 90, the arm assembly 36 moves from the locked, or initial position 36B of FIG. 6C to the ready position 36A of FIG. 6A. It can be seen that the arm assembly pivots by less than 45° in moving between the initial and ready positions, with the pivot angle being less than half the approximately 90° of pivoting in the prior art shown in FIG. 2. Also, it can be seen that even in the ready position of FIG. 6A, at least part of the bolt lip 130 (FIG. 12) lies within the recess formed by the cups 34, 44. When a user unlocks the latch 90, the arm assembly moves, because once the bolt 48 has been extended sufficiently (by rotation of the key 50) to clear the striker plate 32, the arm assembly 36 is automatically urged away from the floor 42 by the spring 76. Further rotation from the floor is restricted by the tabs 70. In the ready position 36A of FIG. 6A, the arm assembly is prepared for engagement with the striker plate 32 no matter what the orientation is of the body 24. The restoring force of the spring 76 prevents gravity from moving the arm assembly 36 closer to the floor 42 and the tabs 70 prevent gravity from moving it past an abutting relationship with the tabs. This control and restraint not only places the arm assembly 36 in position for engagement of the striker plate but prohibits positions such as that of FIG. 3 where the arm assembly 36 presents a danger to other structure and/or personnel. The arm assembly locked position 36B is further illustrated by FIG. 7 which is a top plan view of the embodiment 90. In this view, the key 50 is rotated to an upright position to show the tabs 70.

Figure 4:
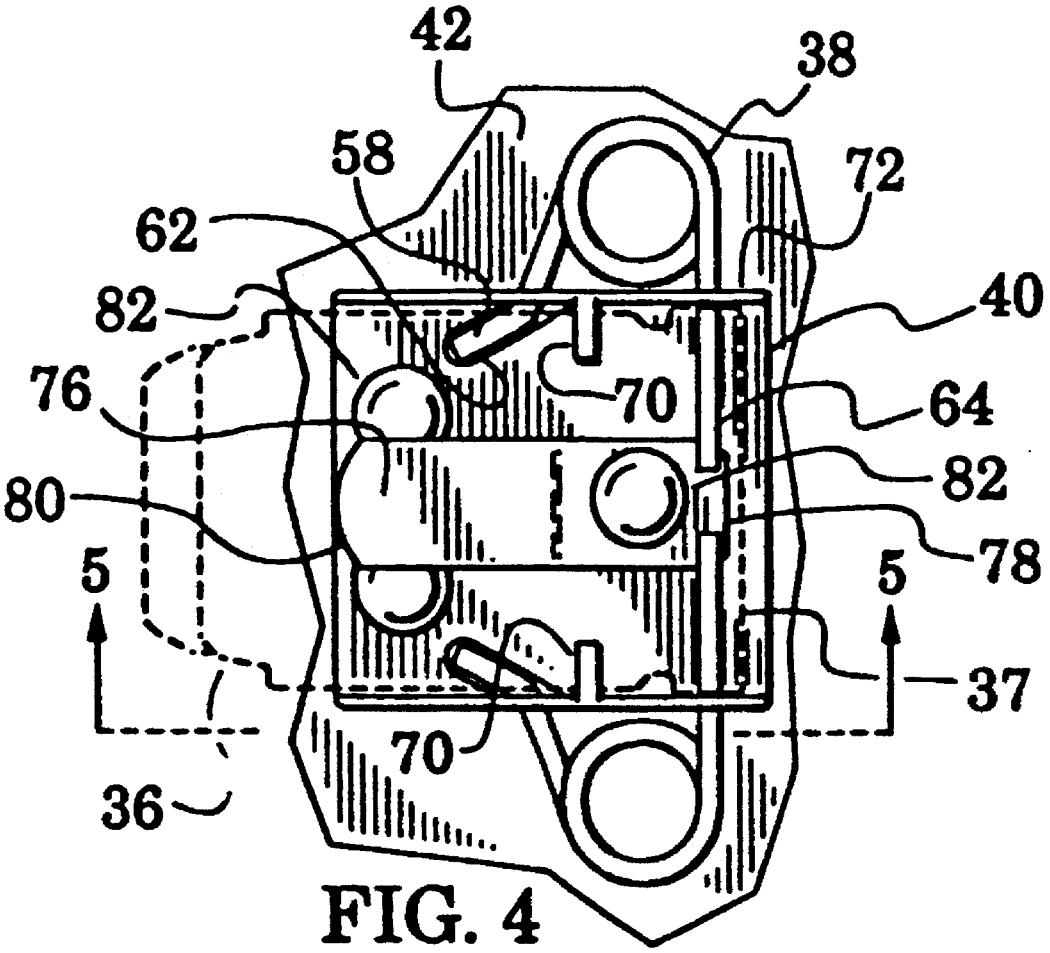
FIG. 4 is a view along the plane 4—4 of FIG. 3 illustrating a preferred arm restraint and control embodiment in accordance with the present invention.
Figure 8A:
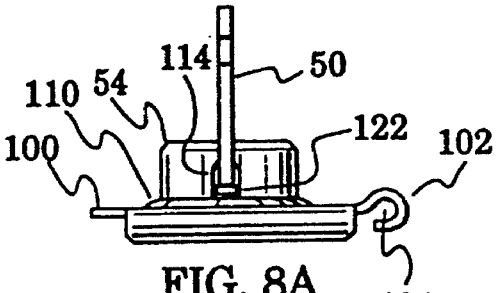
FIG. 8A (PRIOR ART)
FIG. 8A is a side elevation view of portions of the arm assembly of FIGS. 1–3.
Figure 8C:
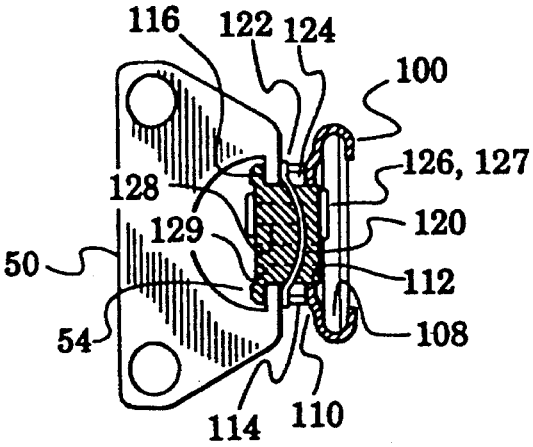
FIG. 8C (PRIOR ART)
FIG. 8C is a view along the plane 8C—8C of FIG. 8B.
Figure 8B:
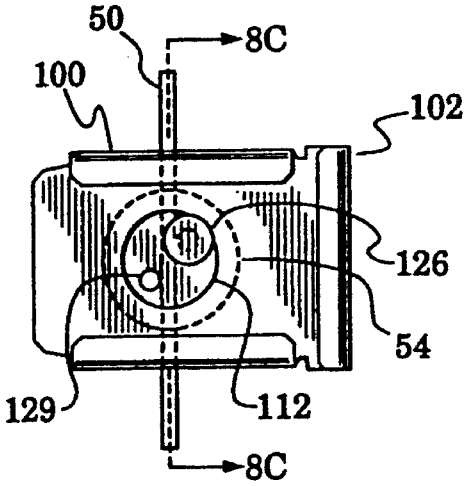
FIG. 8B (PRIOR ART)
FIG. 8B is a bottom plan view of the structure of FIG. 8A.

Attention is now directed to the detailed prior art structure of the arm assembly 36 of FIGS. 1–3. The arm assembly 36 includes a housing 100 which is illustrated in the side elevation and bottom plan views of FIGS. 8A and 8B and in FIG. 8C which is a view along the plane 8C—8C of FIG. 8B. The housing 100 is rolled at one end 102 to form the arm pivot end 37 indicated in FIG. 1. Thus the housing defines a partially open tube 104 which rotatably receives the free ends 64 of the coil springs 76 as shown in FIGS. 4, 5. The lateral sides of the housing 100 are folded over to form slots 108 which slidingly receive the bolt 48 as will be described below.

A central portion of the housing 100 rises in a dome 110 which is pierced by an aperture 112. FIGS. 8 also show how the cylinder 54 is rotatably received into the aperture 112. The cylinder 54 defines diametrically opposed slots 114 which pivotably receive ears 116 of the key 50. A spring washer 120 is arcuately shaped to abut the top surface of the dome 110. Diametrically opposed sides of the washer 120 rise from the dome 110 and define tabs 122 that abut the key ears 116. The remainder of the spring washer 120 is received in an annular groove 124 in the base of the cylinder 54. The head 126 of a rivet 127 installed through a hole 128 in the cylinder 54 is spaced from the lower surface of the dome 110 to retain the cylinder 54 in the aperture 112. Thus, the cylinder 54 and key 50 are rotatably retained in the housing 100.

The key 50 has two stable positions; an upright one shown in FIG. 8 and the stowed position shown in FIG. 6C. When the key 50 is rotated between these stable positions, edges of the ears 116 depress the spring washer tabs 122. The restoring force of the spring washer 120 urges the tabs 122 upward to urge the key 50 to one or the other of its stable positions. The cylinder 54 also defines a hole 129 parallel to the hole 128. The hole 129 is spaced (offset) from the center axis of the cylinder 54 so that it travels along a circle when the cylinder is rotated. The purpose of this circular travel is described below.

Figure 10A:
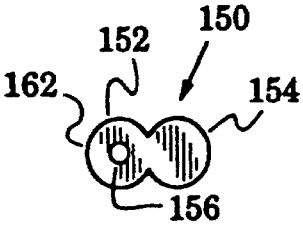
FIG. 10A (PRIOR ART)
FIG. 10A is a plan view of a connecting rod in the arm assembly of FIGS. 1–3.
Figure 10B:
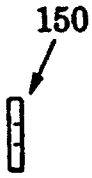
FIG. 10B (PRIOR ART)
FIG. 10B is an end view of the connecting rod of FIG. 10A.
Figure 9A:
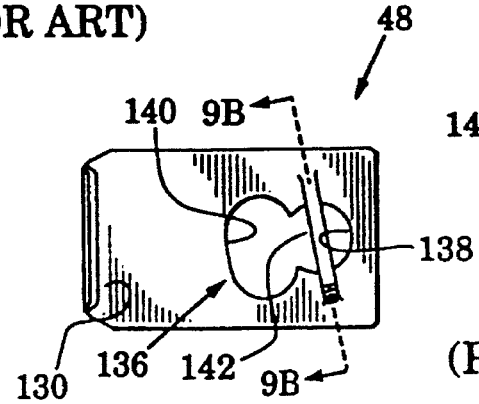
FIG. 9A is a bottom plan view of a bolt in the arm assembly of FIGS. 1–3.
Figure 9B:
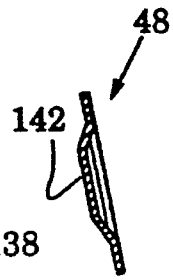
FIG. 9B (PRIOR ART)
FIG. 9B is a view along the plane 9B—9B of FIG. 9A.

FIGS. 9A and 9B are respectively a plan view of the bolt 48 and a view along the plane 9B—9B of FIG. 9A. In these views, the bolt 48 is seen to define, at one end, a lip 130 shaped to engage a corresponding upward extending lip of the striker plate 32 (see FIG. 6, for example). The central part of the bolt 48 defines an opening 136 having a cylindrically shaped first portion 138 connected to a cam-shaped second portion 140. A strip 142 of the bolt 48 is swaged outward as shown in the figures. The opening 136 and strip 142 are configured to receive a connecting rod 150 illustrated in the plan and side views respectively of FIGS. 10A and 10B. The connecting rod 150 is configured to have a shape similar to the figure eight, i.e., it has two spaced cylindrical ends 152, 154. The end 152 defines a hole 156 at its center and has a lateral extremity 162. The thickness of the connecting rod 150 is approximately that of the bolt 48.

Figure 11A:
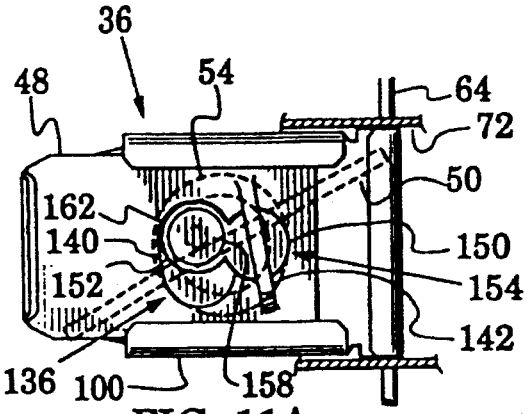
FIG. 11A (PRIOR ART)
FIG. 11A illustrates a position in the operation of the arm assembly of FIGS. 1–3.
Figure 11B:
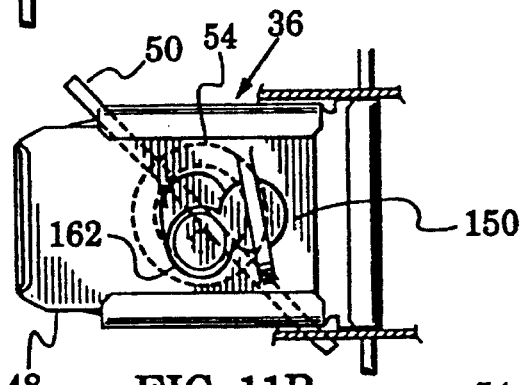
FIG. 11B (PRIOR ART)
FIG. 11B illustrates another position in the operation of the arm assembly of FIGS. 1–3.
Figure 11C:
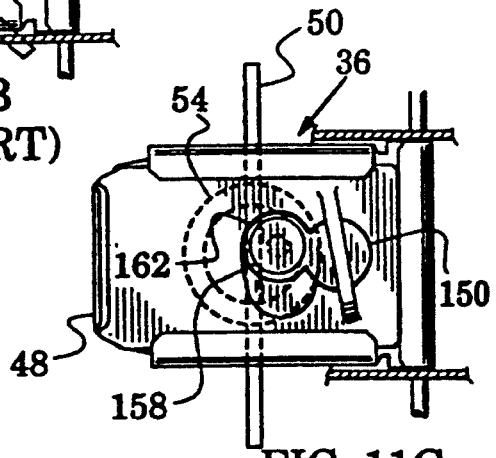
FIG. 11C (PRIOR ART)
FIG. 11C illustrates another position in the operation of the arm assembly of FIGS. 1–3.

The operation of the arm assembly 36 is illustrated in FIGS. 11A, 11B and 11C. The assembly 36 includes the bolt 48 of FIG. 9, the connecting rod 150 of FIG. 10 and the parts of FIG. 8. The bolt 48 is slidingly received in the housing slots (108 in FIG. 8C) with the connecting rod 150 rotatably received in the opening 136. The rod end 154 is captured between the housing 100 and the bolt strip 142. A rivet 158 passes through the hole (156 in FIG. 10A) of the connecting rod 150 and the hole (129 in FIG. 8B) of the cylinder 54. As described above, the arm assembly 36 rotates on the spring free ends 64 and is retained between the bracket sides 72.

Figure 12:
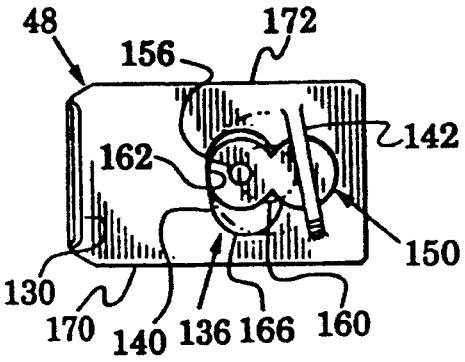
FIG. 12 illustrates the interaction of the bolt of FIG. 9 and the connecting rod of FIG. 10 in the operation illustrated in FIG. 11.

The operation illustrated in FIG. 11 can be best understood with reference to FIG. 12 which shows the bolt 48 and the connecting rod 150 mated together. Because of the offset location of the cylinder hole 129, it must travel along a circle indicated by the broken line 160 as the cylinder 54 rotates. Consequently, the outer extremity 162 of the connecting rod 150 will travel along the arc indicated by the broken line 166. It is apparent from FIG. 12 that the extremity 162 will be accommodated by the cam-shaped portion 140 in the portion of the arc 166 adjacent the bolt side 170. However, adjacent the bolt side 172, the arc 166 travels outside the extent of the cam-shaped portion 140. Since the rod extremity 162 can move only within the portion 140, its travel is thus limited to the lower portion of the arc 166.

Rotation of the key 50 is transmitted through the rivet 158 to cause corresponding rotation of the end 152 of the connecting rod 150. The end 152 abuts the edges of the cam-shaped portion 140 to consequently cause lateral movement of the bolt 48. In FIG. 11B, the key 50 has been rotated to place the extremity 162 of the connecting rod approximately midway in its travel along the arc 166 of FIG. 12. At this point the bolt 48 extension from the arm assembly 36 is between its extreme positions.

Rotation of the key 50 from the position of FIG. 11B to that of FIG. 11A brings the rod extremity 162 to the limit of its travel along the arc 166 of FIG. 12. The bolt 48 is now fully extended by movement of the end 152 along the cam shape of the opening portion 140. Rotation of the key 50 from the position of FIG. 11B to that of FIG. 11C brings the rod extremity 162 again to the limit of its travel along the arc 166 of FIG. 12. The bolt 48 is now fully retracted by movement of the end 152 along the cam shape of the opening portion 140. As described above, this latter bolt position is assumed when the bolt 48 fully engages the striker plate as shown, for example, in FIG. 6C. When this occurs, the restoring force of the springs 38 and the resistance of the striker plate 32 combine to urge the bolt 48 out of the housing 100. However, the rivet 158 is now above the center line of the cylinder 54. Movement of the bolt 48 to the left in FIG. 11C would required the rivet to travel further counterclockwise along the circle 160 of FIG. 12. This is not possible because the extremity 162 is at the end of its travel along the arc 166 of FIG. 12. Thus the bolt 48 is locked into the position of FIG. 11C. It can only be moved from this position by a user rotating the key 50 to move the rivet 158 in the clockwise direction so that it passes below the centerline of the cylinder 54.

From the foregoing it should now be recognized that embodiments of a latch assembly have been disclosed herein having structure for automatically positioning the latch in a ready position. The ready position facilitates securement together of first and second members, e.g., an equipment case lid and body, by preventing abutment of a latch bolt and striker plate. The ready position also reduces the hazard of uncontrolled latch parts. Although the preferred embodiments have been described in association with recessed cups, e.g., cups 34, 44 of FIGS. 6, the teachings of the invention may be extended to latches mounted without benefit of such recessed structure.

The preferred embodiments of the invention described herein are exemplary and numerous modifications, dimensional variations and rearrangements can be readily envisioned to achieve an equivalent result, all of which are intended to be embraced within the scope of the appended claims.

What is claimed is:

1. Apparatus for securing together a body and a lid of a case first and second members, comprising:

first and second members;

walls on said members which form a recess when said members lie adjacent to each other;

a strike member configured for attachment to said first member;

a support configured for attachment to said second member;

an arm pivotally carried on said support to pivot toward and away from an initial arm position;

a resilient element disposed between said arm and said support to urge pivoting of said arm away from said initial arm position;

a bolt carried by said arm for reciprocal movement therealong to engage said strike member when said arm lies in said initial arm position; and an abutment carried by said support and positioned in the path of said arm when it pivots away from said initial position, to abut said arm and prevent pivoting thereof past a ready position that is angularly spaced by less than 45° from said initial position;

said bolt having a strike-engaging lip that lies at least partially within said recess when said arm lies in said ready position and said first and second members lie adjacent to each other.

* * * * *